US005613614A

United States Patent [19]

Richardson

[11] Patent Number: 5,613,614

[45] Date of Patent: Mar. 25, 1997

[54] STORAGE RACK

[76] Inventor: David J. Richardson, 2511 140th Pl. SE., Mill Creek, Wash. 98012

[21] Appl. No.: 489,755

[22] Filed: Jun. 13, 1995

Related U.S. Application Data

[63] Continuation-in-part of Ser. No. 229,758, Apr. 19, 1994, abandoned.

[51] Int. Cl.[6] ..... A47F 5/00

[52] U.S. Cl. ..... 211/89

[58] Field of Search ..... 211/89, 124, 13, 211/60.1, 94, 87; 248/500

[56] References Cited

U.S. PATENT DOCUMENTS

| | | | |
|---|---|---|---|
| 496,696 | 5/1893 | Nash | 211/89 |
| 584,229 | 6/1897 | Mayer | 211/89 X |
| 2,491,652 | 12/1949 | Feerick . | |
| 2,695,105 | 11/1954 | Mitchell | 211/89 X |
| 3,650,502 | 3/1972 | Langhi | 211/89 X |
| 4,286,717 | 9/1981 | Liesinger | 211/89 X |

*Primary Examiner*—Alvin C. Chin-Shue
*Assistant Examiner*—Sarah L. Purol

[57] ABSTRACT

The primary part of the rack is a beam having an essentially H shaped cross section having two sides and a web interconnecting them. A length of bungee cord is threaded through a series of holes in the web to provide a series of exposed, end to end lengths of the cord, each length being usable to retain a stored object against the edges of the sides of the beam. In one embodiment of the invention pins may be inserted in holes across the beam to provide spans of cord shorter than the distance between holes. In an alternate embodiment clips engage the cord and are attachable to the web at any of a plurality of openings. The pattern of the installation of the cord is such that the length of cord serving each exposed length is approximately 3 times the exposed length.

11 Claims, 3 Drawing Sheets

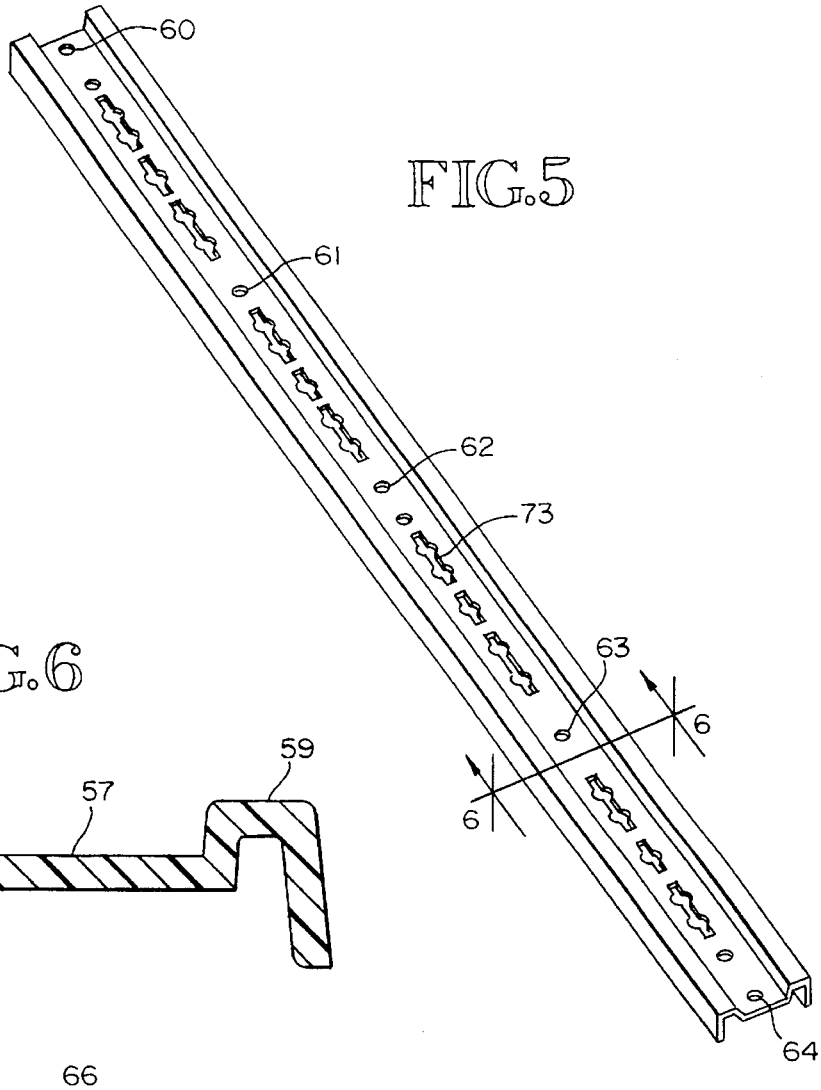
FIG. 5
FIG. 6
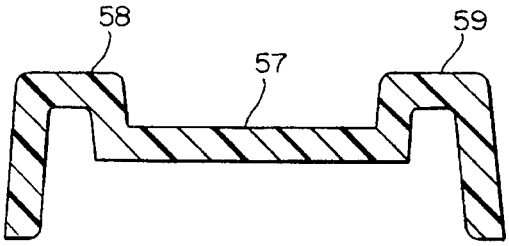
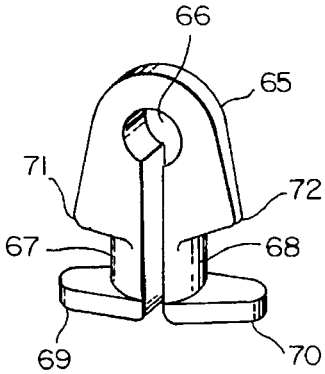
FIG. 7
FIG. 7A
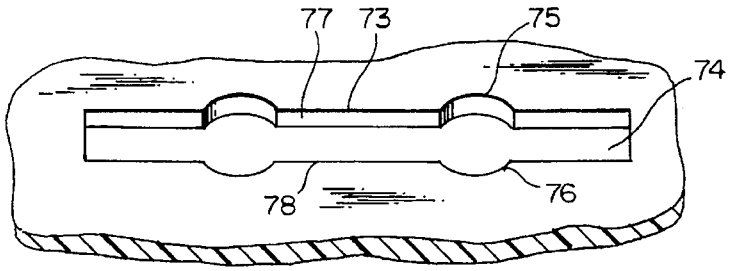

STORAGE RACK

The subject application is a C.I.P. application based on application Ser. No. 229,758, filed Apr. 19, 1994, to be abandoned when the subject application is duly filed.

BACKGROUND OF THE INVENTION

1. Field

The subject invention is in the field of apparatus used for holding objects, materials and the like when they are not in use, i.e. being stored. In particular it is in the field of such apparatus which fits long, narrow spaces and on which the stored items are held by cords, specifically elastic cords.

2. Prior Art

There is much prior art in this field and the patents listed below are a sampling of the patented prior art.

| U.S. Patents: | |
|---|---|
| 2,366,483 | 3,812.976 |
| 2,491,652 | 4,079,839 |
| 2,518,989 | 4,826,717 |
| 2,529,372 | 4,291,810 |
| | 5,117,988 |

Among the patented and non-patented prior art known to the inventor of the subject invention there is no prior art storage rack which can be used in long, narrow spaces and uses cords to hold stored items in place on the rack. Accordingly, the prime objective of the subject invention is to provide such a storage rack. Other objectives are that the rack be economical to manufacture, and that it be adaptable to hold articles in a wide variety of shapes and sizes.

SUMMARY OF THE INVENTION

The subject invention is a storage rack intended for use in long, narrow spaces against a wall or similar mounting surface. The basic element of the rack, in one preferred embodiment, is a beam about 80 inches long and 1½ by 3 inches in cross section. The cross sectional shape is in the form of the letter H with the 3 inch dimension being the width. The portion between the two sides is termed the web. The beam is fastened to a mounting surface with the web parallel to the surface. The sides are flanged and the mounting fasteners fit through holes in the flanges. There is a plurality of holes evenly spaced along the center line of the web and a bungee cord is installed such that there is a single exposed portion of cord running from hole to hole. To store an object, the cord portion between two openings is lifted from the web, the object is placed against the edges of the sides which extend away from the mounting surface and the cord portion is allowed to retract against the object to hold it in place. To hold relatively small objects more securely the length of exposed cord portion used is reduced to less than the spacing between two holes by insertion of a pin crosswise through the sides of the beam to hold the cord close to the web at the pin location. Holes are provided along the beam for use of the cross pins. One length of cord can serve all the holes, if desired. In a preferred pattern for installing the cord in the holes, one end of the cord is anchored to the back face of the web along side the first one of the openings, the cord runs through the next opening from back to front of the web, along the web to the first hole, through the first hole front to back and along the back face to a second anchor point adjacent the second opening but on the side opposite from the first anchor point. The cord then runs to the third opening, through it from back-to-front, along the web to the second opening, through it from front-to-back and then to a third anchor point adjacent to the third opening and on the same side of the centerline of the beam as the first anchor point. This pattern repeats for each 3 holes in line but can be interrupted at any opening as needed to suit the length of a beam. The cord is anchored by being clamped between a washer and the web by a fastener threaded through the web. This cord installation pattern is such that the cord length serving each exposed length is 3 times the length of the exposed length.

In a second preferred embodiment the beam is about 45 inches long and 1 inch by 3 inches in cross section and the cross sectional shape is a modified H-shape in which the vertical portions of the H are channels. The fasteners for mounting the rack in a flat surface fit through fastener bosses spaced along the center of the web. Also, in this second embodiment the pins inserted to reduce the active length of exposed cord to less than the spacing between two holes are replaced by U-shaped clips which engage slots provided in the web for attachment of the clips to the web.

The invention is described in more detail below with reference to the attached drawings.

BRIEF DESCRIPTION OF THE DRAWINGS

FIG. 5 is a schematic illustration of an alternate embodiment of the beam of the subject rack.

FIG. 6 is a section of the beam shown in FIG. 5, taken at 6—6 in FIG. 5.

FIG. 7 illustrates the clips used to shorten the effective lengths of cord used to retain various objects on the rack.

FIG. 7A illustrates in detail the opening for attachment of a clip.

DETAILED DESCRIPTION OF THE INVENTION

Figure 1:
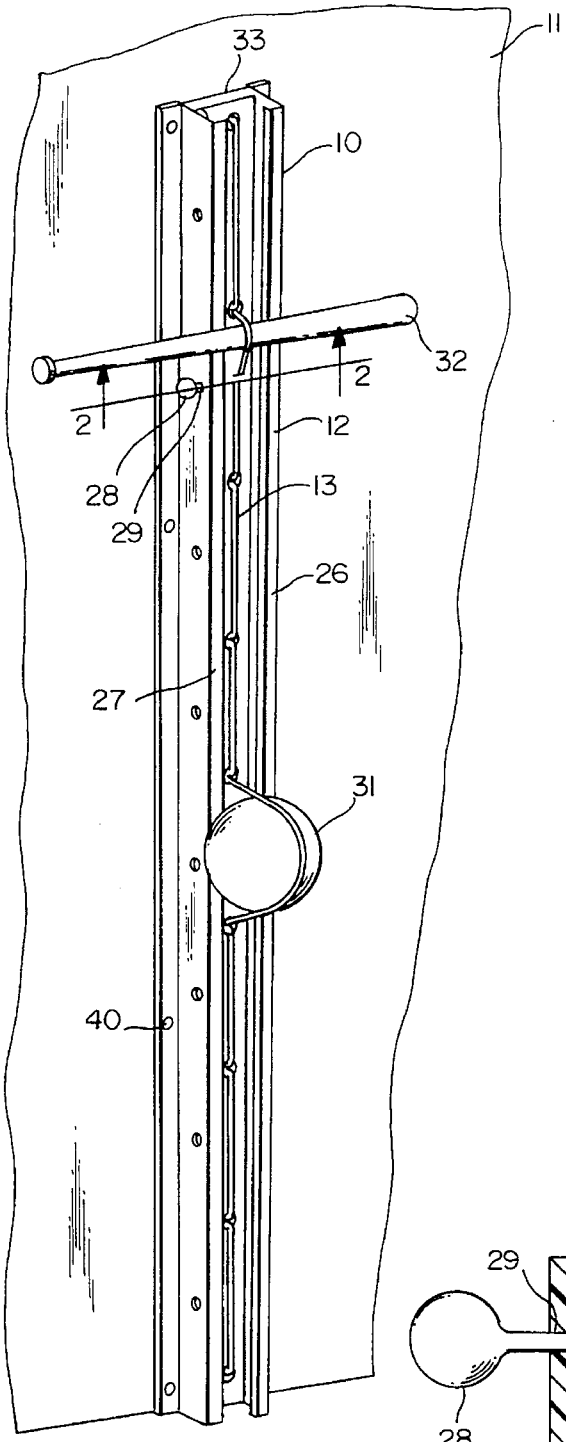
FIG. 1 illustrates the subject rack in use mounted vertically against a wall.
Figure 2:
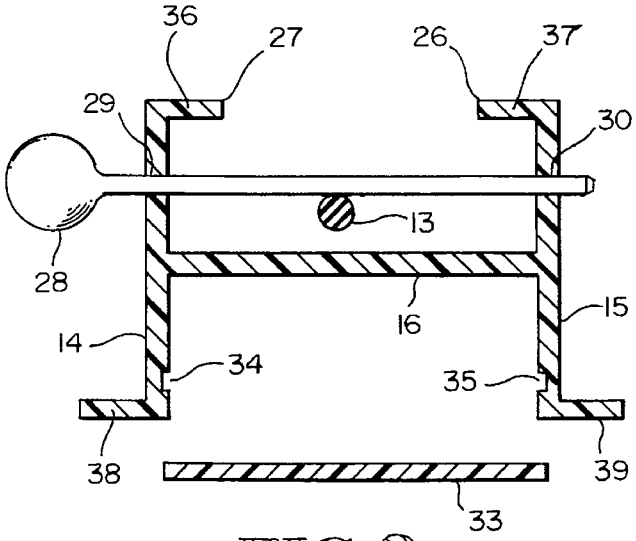
FIG. 2 is a section taken at 2—2 in FIG. 1.
Figure 3:
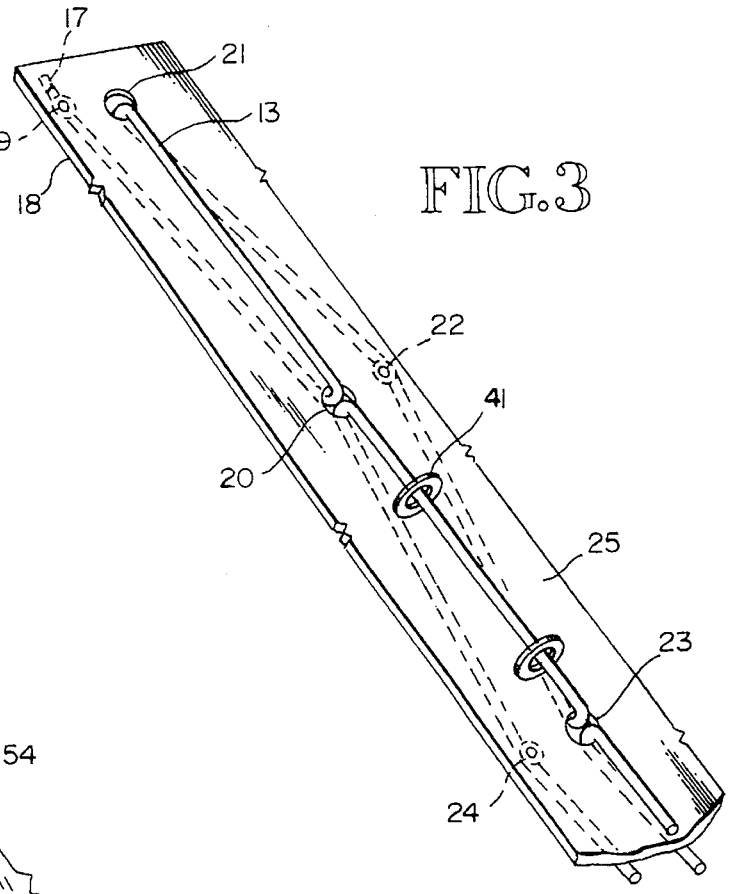
FIG. 3 is a schematic view illustrating a preferred pattern for installation of the bungee cord.

The subject invention is a storage rack for use in areas which are narrow relative to their length. FIG. 1 illustrates rack 10 mounted vertically on wall 11. The rack comprises beam 12 with bungee cord 13 installed as described below. FIG. 2 is a section taken at 2—2 in FIG. 1 illustrating that the beam is generally H shaped in cross section, having sides 14 and 15 and web 16 interconnecting them. FIG. 3 is a schematic illustration of a section of the web with the cord installed in a preferred way. End 17 of the cord is anchored to face 18 of the web at 19. The cord extends from 19 through hole 20, then to and through hole 21 to anchor point 22, then to and through hole 23, then through hole 20 to anchor point 24. This pattern is repeated throughout the length of the web. However, for a shortened embodiment only holes 20 and 21 are needed, along with a cord extending from anchor point 17 to anchor point 22. This installation pattern provides a plurality of lengths of cord having an active spans extending from hole to hole on face 25 of the web. To store an object in the rack a length is lifted and placed over the object which rests between edges 26 and 27 of the rack (FIG. 1). The length of the portion of the cord affected by lifting the length of cord between two holes is essentially three times the length of cord between holes. For smaller objects the active span of cord involved is reduced by inserting a pin, pin 28 being typical, through holes in the sides of the beam, holes 29 and 30 being typical. Ball 31 in FIG. 1 is an example of a larger item held in the rack and bat 32 is an example of an item requiring a shorter span of cord. The short span can be between a hole and a pin or between two pins. The cord is anchored at the various points by a threaded fastener and a washer, the threaded fastener being threaded into the web and pressing a washer against the cord. The cord exposed on face 18 can be covered by a back plate 33 fitted into groves 34 and 35 in the beam (FIG. 2). Flanges 36 and 37 stiffen the sides of the rack and flanges 38 and 39 also stiffen the sides and the rack is mounted by fasteners in holes in flanges 38 and 39, hole 40 being typical.

Handles, handle 41 being typical, may be installed on the bungee cord to facilitate handling it.

Figure 4:
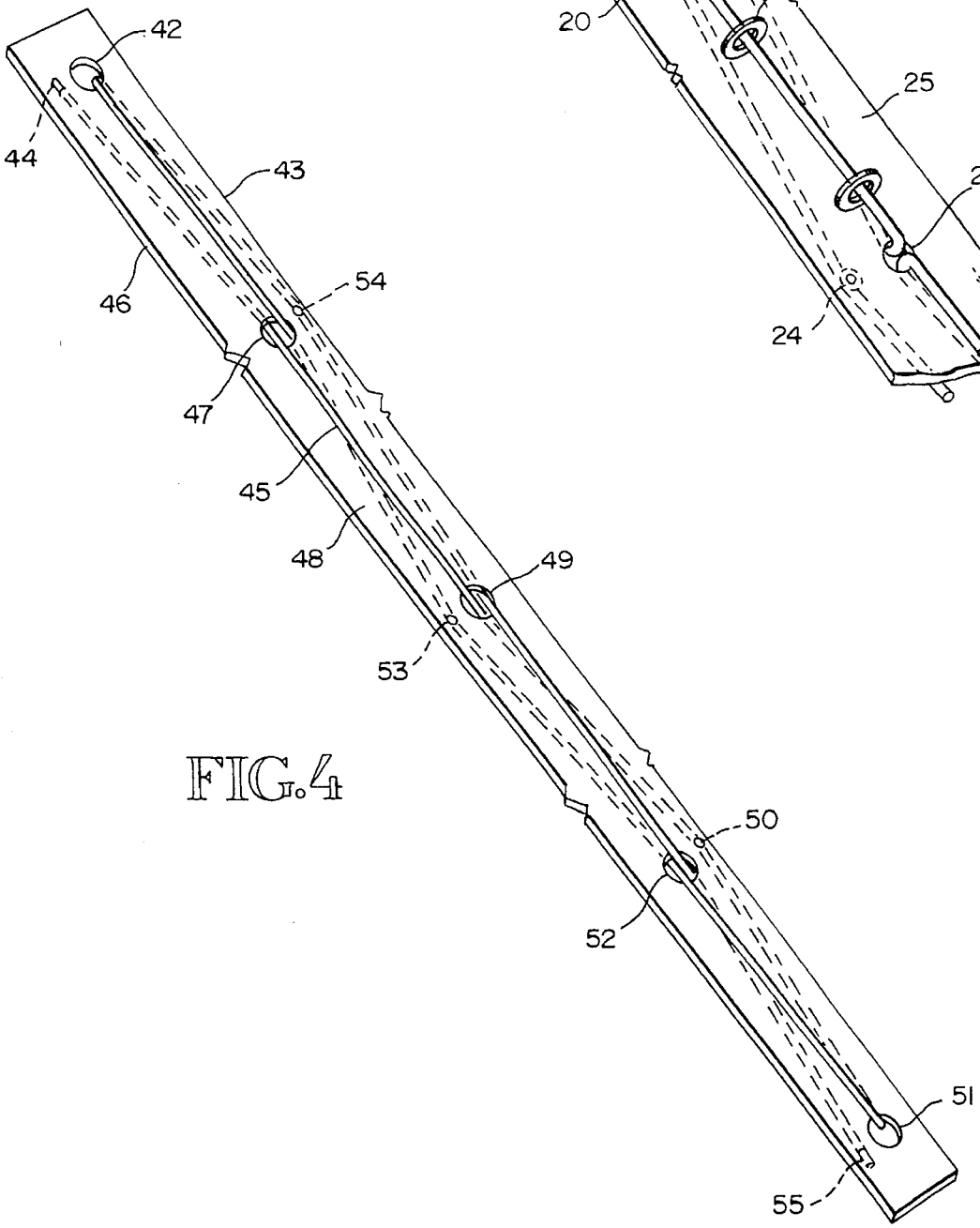
FIG. 4 illustrates an alternate pattern for installation of the bungee cord.

FIG. 4 illustrates an alternate pattern for installation of the bungee cord. In this particular embodiment there are five holes, hole 42 being typical, evenly spaced along web 43. End 44 of cord 45 is anchored to the underface 46 of the web near hole 42. The cord then runs through hole 47, across surface 48 of the web, through hole 49, along face 46, to anchor point 50, then up through hole 51, along face 48 and down through hole 52 to anchor point 53, then to and up through hole 47, along to and down through hole 42, to anchor point 54, then to and up through hole 49, along face 48 to and down through hole 50 to anchor point 55. In this embodiment also use of a cord portion between two holes affects a cord portion having at least three times the length of the portion between holes.

In an alternate embodiment two cords are used, side-by-side, providing more secure attachment for certain types of objects being stored. Also, handles may be provided at intervals along the cord to facilitate picking up and holding the cord(s).

FIG. 5 is a schematic illustration of an alternate embodiment of the beam of the subject rack and FIG. 6 is a section taken at 6—6 in FIG. 5 and illustrates the cross sectional shape of the beam. The cross sectional shape is essentially in the form of an H having a web 57 and with channel portions 58 and 59 forming the sides or vertical portions of the H. The cord is attached to the web as described above, using holes 60, 61, 62, 63 and 64.

FIG. 7 illustrates one of the clips 65 used to shorten effective lengths of cord used to retain various objects on the rack. The clip is made of elastomeric material and has an eye 66, legs 67 and 68, feet 69 and 70 and shoulders 71 and 72. The clips attach to the web in a plurality of openings, opening 73 in FIG. 5 being typical and shown in more detail in FIG. 7A. Each opening is a slot 74 with at least one pair of opposed circular arcs 75 and 76 in sides 77 and 78 of the slot. A clip is attached to the web by inserting the feet of a clip through an opening between the arcs until the shoulders of the clip contact the web and then turning the clip 90° so that the feet engage the underside of the web to hold the clip in place. Prior to installing a clip it is snapped over the cord so that the cord passes through the eye and is held by the attached clip.

It is considered to be understandable from the above description that the subject invention meets its objectives. It provides a storage rack which can be used in long, narrow spaces and uses a cord to hold stored items in place. It is economical to manufacture because of its simplicity and is adapted to holding articles in a wide variety of shapes and sizes.

It is also considered to be understandable that while certain embodiments of the invention are described herein, other embodiments and modifications of those described are possible within the scope of the invention which is limited only by the attached claims.

I claim:

1. A storage rack comprising a beam and at least one bungee cord, said beam having a length and a cross sectional shape having a web, said web having a plurality of holes along said length with equal distances between said holes, said bungee cord being installed in said holes and anchored to said web such that there is a plurality of first equal lengths of said cord with each of said plurality of first lengths extending from one of said holes to another and such that lifting each of said lengths from said web affects a portion of said cord, said portion having a second length, said second length being essentially three times said first length, each of said equal distances being a first span of action of said bungee cord, said rack further comprising means for providing at least one second span of action shorter than said first span of action.

2. A storage rack comprising a beam and at least one bungee cord, said beam having a length and a cross sectional shape having a web, said web having a plurality of holes along said length with equal distances between said holes, said bungee cord being installed in said holes and anchored to said web such that there is a plurality of first equal lengths of said cord with each of said plurality of first lengths extending from one of said holes to another and such that lifting each of said lengths from said web affects a portion of said cord, said portion having a second length, said second length being essentially three times said first length, said rack further comprising handles attached to said first equal lengths of said cord.

3. The rack of claim 2 in which each of said equal distances is a first span of action of said bungee cord and said rack further comprises means for providing at least one second span of action shorter than said first span of action.

4. The rack of claim 1 in which each of said equal distances is a first span of action of said bungee cord and said rack further comprises means for providing at least one second span of action shorter than said first span of action.

5. The rack of claim 1 further comprising handles attached to said first equal lengths of said cord.

6. The rack of claim 4 further comprising handles attached to said first equal lengths of said cord.

7. A storage rack comprising a beam and at least one bungee cord, said beam having a length and an H-shaped cross section and comprising two sides interconnected by a web, said web having a plurality of holes along said length with equal distances between said holes, said bungee cord being installed in said holes and anchored to said web such that there is a plurality of first equal lengths of said cord with each of said plurality of first lengths extending from one of said holes to another and such that lifting each of said lengths from said web affects a portion of said cord, said portion having a second length, said second length being essentially three times said first length.

8. The rack of claim 6 in which each of said equal distances is a first span of action of said bungee cord and said rack further comprises means for providing at least one second span of action shorter than said first span of action.

9. The rack of claim 7 further comprising handles attached to said first equal lengths of said cord.

10. The rack of claim 8 further comprising handles attached to said first equal lengths of said cord.

11. A storage rack comprising a beam and at least one bungee cord, said beam having a length, first and second ends and an H-shaped cross section and comprising two sides interconnected by a web, said web having first and second holes, said first hole being near said first end and said second hole being near said second end, said bungee cord being installed in said holes with a first length of cord between said holes and anchored to said web such that lifting said cord from said web between said first and second holes affects a second length of cord, said second length being approximately three times said first length.

* * * * *